US005814369A

United States Patent [19]

Bockh et al.

[11] Patent Number: 5,814,369

[45] Date of Patent: Sep. 29, 1998

[54] SYSTEM AND METHOD FOR DEPOSITING MEDIA IN A PATTERN ON A MOVING SHEET USING A MEDIA RETAINING MEMBER

[75] Inventors: Mat Bockh, Gilford; Thomas J. Zickell, Stratham, both of N.H.; Charles Diman, Billerica; Stephen Mahoney, Cambridge, both of Mass.

[73] Assignee: Environmental Reprocessing, Inc., Brentwood, N.H.

[21] Appl. No.: 572,125

[22] Filed: Dec. 14, 1995

[51] Int. Cl.[6] ..... B05D 1/40

[52] U.S. Cl. ..... 427/188; 427/197; 118/211; 118/212; 118/308

[58] Field of Search ..... 427/186, 188, 427/197, 287, 288; 118/211, 212, 308

[56] References Cited

U.S. PATENT DOCUMENTS

| | | | |
|---|---|---|---|
| 1,250,577 | 12/1917 | Goldberg . | |
| 2,000,077 | 5/1935 | Harshberger | 91/18 |
| 2,037,822 | 4/1936 | Robert | 427/188 |
| 2,728,685 | 12/1955 | Muench | 117/25 |
| 3,239,367 | 3/1966 | Demeter | 117/68 |
| 3,360,393 | 12/1967 | Rhorer | 118/212 |
| 3,534,787 | 10/1970 | Heck | 141/131 |
| 3,548,781 | 12/1970 | Hornung | 118/212 |
| 3,627,557 | 12/1971 | Sato et al. | 117/37 |
| 3,639,050 | 2/1972 | Staller | 355/3 |
| 3,730,397 | 5/1973 | Magnus | 222/254 |
| 3,924,561 | 12/1975 | Ruhart et al. | 118/9 |
| 4,055,688 | 10/1977 | Caratsch | 427/197 |
| 4,060,651 | 11/1977 | DaMert | 427/285 |
| 4,064,288 | 12/1977 | Shah et al. | 427/58 |
| 4,141,313 | 2/1979 | Hefele | 118/212 |
| 4,264,644 | 4/1981 | Schaetti | 118/204 |
| 4,295,445 | 10/1981 | Kopenhaver | 118/695 |
| 4,343,260 | 8/1982 | Yajima et al. | 118/204 |
| 4,352,837 | 10/1982 | Kopenhaver | 427/187 |
| 4,478,869 | 10/1984 | Brady et al. | 427/10 |
| 4,497,274 | 2/1985 | Focke | 118/212 |
| 4,529,625 | 7/1985 | Reidenbach et al. | 427/186 |
| 4,752,510 | 6/1988 | Hallworth | 427/256 |
| 4,900,589 | 2/1990 | Montgomery | 427/188 |
| 5,037,671 | 8/1991 | Kärnä et al. | 427/287 |
| 5,048,453 | 9/1991 | Eriksson | 118/249 |
| 5,093,158 | 3/1992 | Li et al. | 427/278 |
| 5,101,759 | 4/1992 | Hefele | 118/202 |
| 5,251,989 | 10/1993 | Di Luco | 400/240.3 |
| 5,283,080 | 2/1994 | Lamb et al. | 427/8 |
| 5,382,291 | 1/1995 | Olioso | 118/212 |
| 5,405,647 | 4/1995 | Grubka et al. | 427/188 |
| 5,415,717 | 5/1995 | Perneborn | 156/276 |
| 5,597,618 | 1/1997 | Bayer, Jr. et al. | 427/207.1 |

*Primary Examiner*—Katherine A. Bareford

*Attorney, Agent, or Firm*—Daniel J. Bourque, Esq.; Kevin J. Carroll, Esq.

[57] ABSTRACT

A system and method for depositing a pattern of media on a moving surface includes a media depositing apparatus that deposits media in a predefined pattern on the moving surface. A media applicator roll having a media receiving region, such as engraved or raised portions, receives the media from a media feeder as the media applicator roll rotates. A media retaining member maintains the media in contact with the media receiving region until the media reach a bottom region of the media applicator roll and are released from the media applicator roll in the predefined pattern onto the moving surface. The method for depositing a pattern of media includes synchronizing the speed of rotation of the media applicator roll with the speed of the moving sheet of material so that the media are precisely deposited as they are released from the media receiving region. The method also includes minimizing the distance that the media must drop from the applicator roll receiving region to the moving surface.

24 Claims, 4 Drawing Sheets

SYSTEM AND METHOD FOR DEPOSITING MEDIA IN A PATTERN ON A MOVING SHEET USING A MEDIA RETAINING MEMBER

FIELD OF THE INVENTION

This invention relates to a system and method for depositing a pattern of media and in particular, to a system and method for depositing granules in a predefined pattern on a continuously moving sheet to form a roofing material.

BACKGROUND OF THE INVENTION

A common method of manufacturing roofing materials involves depositing granules on a coated sheet of material, such as a webbed material that is coated with asphalt. A common roofing material is the roofing shingle which presents a well defined and pleasing pattern on a roof. Shingles are time consuming to install, however, and the seams present a potential source of water leaks. Although a continuous sheet of roofing material would be preferable, such a continuous sheet lacks the distinctive "shingle" pattern users have grown accustomed to.

Some attempts have been made at depositing granule patterns on a continuous sheet of material. The continuous sheet of material is unrolled, coated with a tacky material such as asphalt, and moved beneath a granule application device that drops granules onto the tacky coating covering the sheet. Existing granule application devices are limited in that they are not capable of depositing granules in a predefined pattern, such as a pattern simulating overlapping shingles. A sheet of shingle material with a pattern simulating overlapping shingles would be useful and would save considerable time in the roofing industry.

A typical granule application device uses a hopper and a roll or gate rotating beneath the hopper to allow the granules to fall onto the moving sheet of roofing material itself. However, such devices do not adequately control the falling of the granules onto the moving sheet of roofing material and do not allow the granules to be deposited in a predetermined and predefined pattern.

One such prior art granule application device is disclosed in U.S. Pat. No. 4,900,589 to Montgomery. This granule application device includes a series of granule applicators and a sheet that travels under the applicators for receiving the granules. Each applicator includes a roll and gate unit for depositing the granules by allowing the granules to just fall to the sheet. This device does not deposit granules in a predefined pattern on the sheet and does not control the dropping of the granules.

Another device is disclosed in U.S. Pat. No. 4,478,869 to Brady, et al. This device includes a series of hoppers for applying granules to a continuously moving strip. This device provides a means for sensing the amount of excess granules collected in a back fall hopper and for monitoring the rate of discharge of the granules to the back fall hopper. However, this device does not provide a system and method that controls the dropping of granules and deposits granules in a pattern on the continuously moving sheet.

Other granule application systems are overly complex and have been unable to simply and efficiently deposit a pattern of granules on a continuous sheet of shingle material. Such devices are disclosed in U.S. Pat. Nos. 4,295,445 and 4,352,837 issued to Kopenhaver. This type of apparatus and method for manufacturing roofing shingles is a long and complex process in which one stage includes applying a series of bands of coating asphalt with an inking wheel so that the granules will stick to the bands of asphalt in a pattern. Such a complex and time consuming process is expensive and unproductive.

Accordingly, what is needed is a system and method for precisely depositing granules, particles, liquid, or any other type of media, in a predefined pattern on a continuously moving surface. The media depositing system and method should be simple and efficient so as to minimize the production costs and increase productivity. The system and method should control the dropping of the media to precisely deposit the media in a predefined pattern, for example, by controlling the speed and distance at which the media is dropped.

SUMMARY OF THE INVENTION

The present invention features a system and method for depositing a predefined pattern of a medium, such as granules or similar particles or viscous liquids on a moving surface. The system comprises an apparatus for precisely depositing the media in a predefined pattern of any design on a moving surface, such as a moving sheet of material. In one embodiment, the sheet of material is a web material including at least one surface coated with an asphaltic material, for receiving a medium, such as granules, in the predefined pattern.

The apparatus for depositing the media in a predefined pattern on the moving surface comprises a media applicator roll having an media receiving region for receiving the media in the desired predefined pattern, such as an engraved region or raised region. A media retaining member, such as a belt or chute, is provided proximate at least a portion of the media receiving region of the media applicator roll. The media retaining member retains the media in the media receiving region from proximate a top region of the media applicator roll to proximate a bottom region of the media applicator roll.

The media retaining member preferably retains the media in the media receiving region of the media applicator roll until a point proximate the bottom region of the media applicator roll that minimizes the distance that the media fall or drop from the media receiving region to the moving surface. The media retaining member thereby controls the dropping of the media from the media applicator roll to precisely deposit the media in the predefined pattern.

The preferred embodiment of the media depositing system includes at least one media feeder positioned proximate the media applicator roll. The media applicator roll rotates at a predetermined speed at a location above the moving surface as the media feeder feeds the media to the media receiving region of the media applicator roll. In one embodiment, the granule feeder includes a hopper generally extending across a length of the media applicator roll. The hopper includes a gasket positioned around a portion of the hopper in contact with the media receiving region of the media applicator roll.

In one embodiment, the media retaining member includes a media retaining belt, such as an endless belt made of rubber or another suitable material. At least a first roller holds the media retaining belt proximate the media receiving region at a top region of the media applicator roll. At least a second roller holds the media retaining belt in contact with the media receiving region at a bottom region of the media applicator roll. The media retaining belt runs continuously around the first and second rollers as the media applicator roll rotates to maintain the media in contact with the media receiving region from the top region to the bottom region of the media applicator roll.

In one embodiment, the media applicator roll includes a substantially cylindrical sleeve made of a rubber or other suitable material and having the media receiving region, e.g. engraved or raised regions. The substantially cylindrical sleeve is disposed around an internal support. In one embodiment, the substantially cylindrical sleeve is removably fitted on the internal support, and a plurality of sleeves having different media receiving regions corresponding to various predefined patterns can be interchangeably fitted over the internal support to vary the patterns that can be deposited.

The method of depositing media in a predefined pattern on a moving surface according to the present invention comprises the steps of: rotating a media applicator roll at a predetermined speed; moving a surface at a predetermined speed and at a predetermined distance beneath the media applicator roll; feeding media to an media receiving region of the media applicator roll; retaining the media in contact with the media receiving region of the media applicator roll from proximate a top region of the media applicator roll to proximate a bottom region of the media applicator roll; and releasing the media from the media receiving region of the media applicator roll at the bottom region.

The preferred method includes synchronizing the predetermined speed of rotation of the media applicator roll and the predetermined speed of the moving surface. The preferred method further includes positioning the moving surface at a predetermined distance from the media applicator roll to minimize or optimize a distance that the media drop from the media receiving region at the bottom region of the media applicator roll to the moving surface. Synchronizing the speed of rotation of the media applicator roll and the speed of the moving surface and minimizing the distance of the media drop both control the media drop so that the media are precisely deposited in the predefined pattern.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
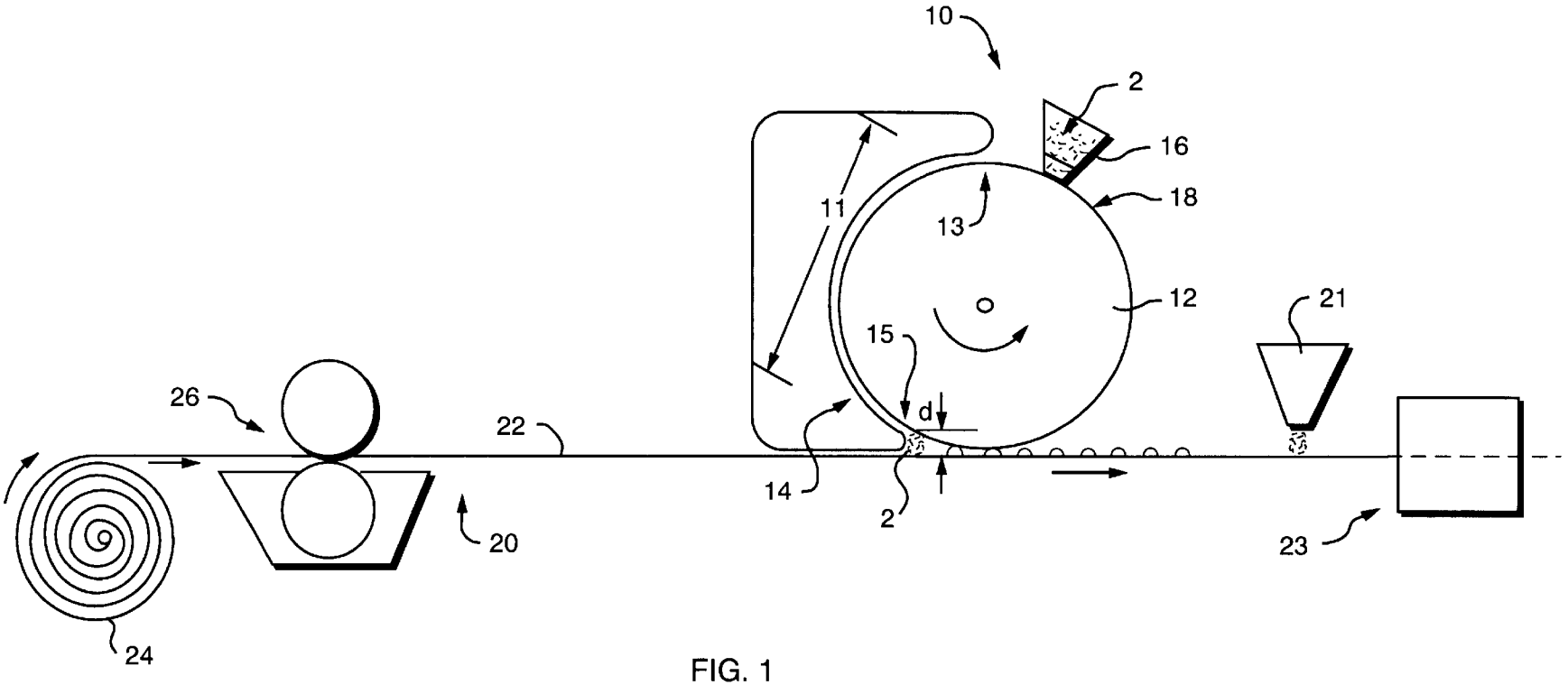
FIG. 1 is a side view of the system for depositing media in a predefined pattern according to the present invention.

A system for depositing media in a pattern according to the present invention includes an apparatus 10, FIG. 1, that deposits media 2, such as mineral and non-mineral media, sawdust, roofing granules, aluminum flakes, resin, ink, or any other particulates or material, in a predefined pattern on a surface 22 moving beneath the apparatus 10. The apparatus 10 for depositing media in a predefined pattern on the moving surface 22 includes a media applicator roll 12 having an media receiving region 18, such as an engraved or raised region, that receives the media in the predefined pattern. The media depositing apparatus 10 further includes a media retaining member 14, such as a belt or chute, proximate at least a portion 11 of the media receiving region 18 of the applicator roll 12 that retains the media 2 in the predefined pattern on the media receiving region 18 until the media 2 are deposited on the surface 22, as will be described in greater detail below.

An exemplary system and method for depositing media in a predefined pattern is a system and method for depositing media, such as granules or similar particles, in a pattern on the surface 22 of a sheet of material 20 to form a roofing material. One example of the pattern includes a shingle pattern that simulates the overlapping, double coverage of roofing shingles. The present invention also includes any pattern including, but not limited to, a slate pattern and a wood pattern.

In the exemplary system and method for depositing media on a sheet of material 20 to form a roofing product, the sheet of material 20 is coated along at least its top surface 22 with a tacky material, such as asphalt, so that the granules or other particles 2 deposited in a predefined pattern will fall to the surface 22 of the material 20. For example, the sheet of material 20 can be a web type material, such as fiber glass, polyester, paper, polyethylene, felt, polypropylene, metal or other similar materials commonly used for roofing, formed as a roll 24. The web material is coated along at least its top surface 22 with the tacky or asphaltic material according to any suitable method well known to those skilled in the art, for example, a conventional coating mechanism 26.

One way of moving the sheet of material 20 beneath the apparatus 10 is by a conventional web or paper conveying machine 23 known to those skilled in the art. The system according to the present invention can also include one or more additional media applicators 21, for example, to lightly coat granules or other media over the entire surface 22 after the predefined pattern of media has been deposited. The system according to the present invention also contemplates more than one media depositing apparatus 10 arranged in a series to deposit a predefined pattern on the moving sheet of material 20.

The present invention contemplates any type and size of mineral or non-mineral particle to be deposited including, but not limited to, roofing granules, sand, slag, aluminum flakes, resin, and sawdust. The present invention also contemplates liquid media, such as resin, ink or other substantially viscous liquids. In addition, the present invention contemplates various types of surfaces 22, with or without a coating, on which the various types of media 2 can be deposited.

In one embodiment, the apparatus 10 for depositing media in a predefined pattern on the moving surface 22 further includes a media feeder 16, such as a hopper, as will be described in greater detail below. The media feeder 16 disposed proximate an upper side region of the media applicator roll 12 at an acute angle from a top most point of the applicator roll 12. As the media applicator roll 12 rotates, the media 2 in the media feeder 16 are fed to the media receiving region 18 of the applicator roll 12. The present invention contemplates any type of media feeder 16 including, but not limited to, a granule feeder, curtain feeder, drag box, gravity feeder, applicator roll, auger, pneumatic feeder, and other similar feeding devices.

In the preferred embodiment, the media retaining member 14 retains the media 2 within the media receiving region 18 along the portion 11 of the media receiving region 18 from a top region 13 to a bottom region 15 of the media applicator roll 12. Proximate the bottom region 15, the media 2 are released from the media receiving region 18 and dropped to the moving surface 22 in the predefined pattern. The distance d that the media 2 drop or fall from the media receiving region 18 of the media applicator roll 12 to the moving surface 22 is preferably minimized so that the media 2 are precisely deposited in the predefined pattern, as will be discussed in greater detail below.

One example of the media retaining member 14 includes a media retaining belt, such as endless belt made of a rubber or other similar material. Other examples of the media retaining member 14 include a chute or similar device generally contoured to match the exterior surface of application roll 12.

Figure 2:
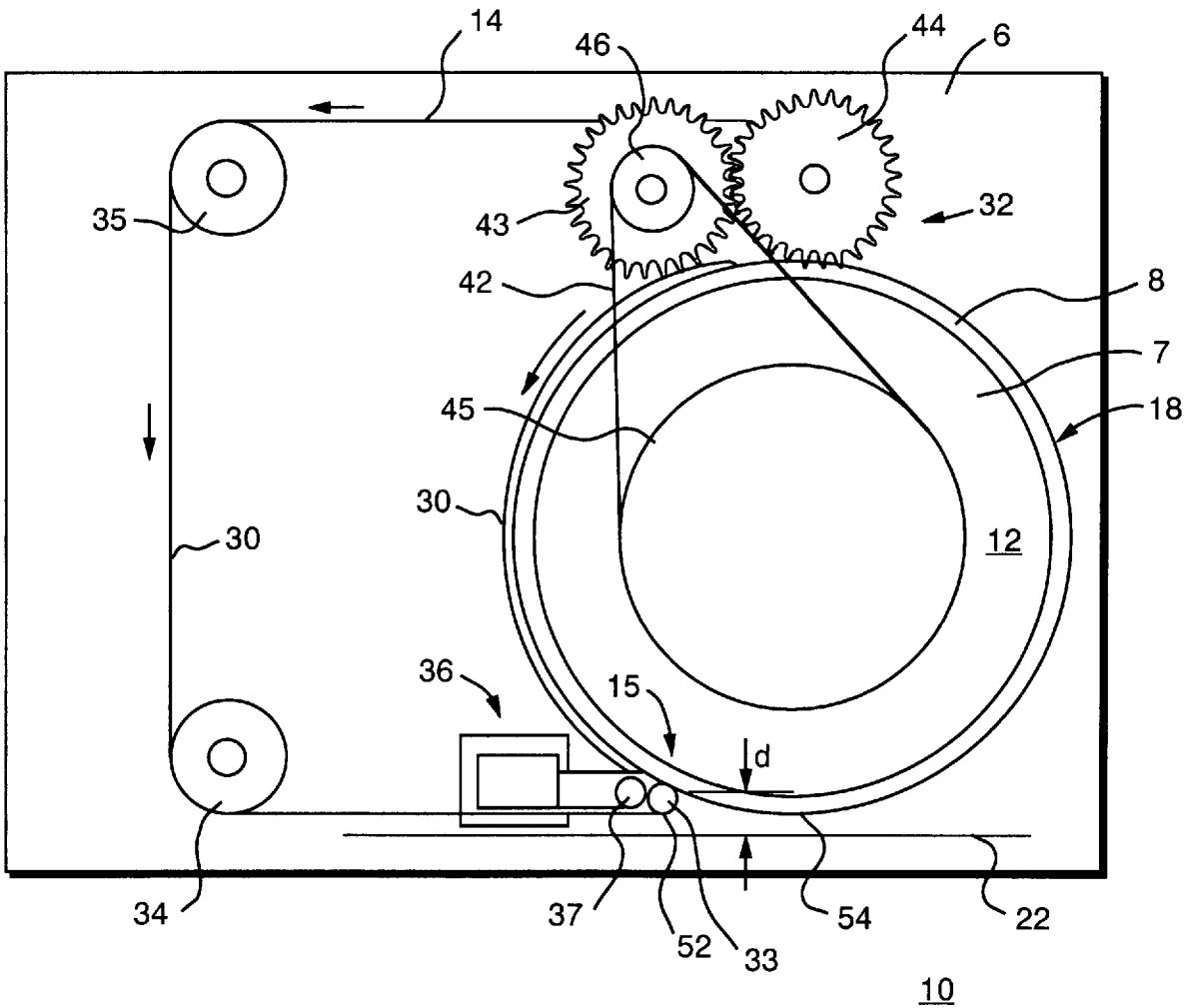
FIG. 2 is a side view of an apparatus for depositing media in a predefined pattern according to one embodiment of the present invention.

In a media depositing apparatus 10, FIG. 2, that uses a media retaining belt 30, the belt 30 runs around a plurality of rollers 32, 33, 34, 35. A first roller 32 holds the media retaining belt 30 proximate the media receiving region 18 of the media applicator roll 12 proximate the top region 13. A second roller 33 holds the media retaining belt 30 proximate the media receiving region 18 proximate the bottom region 15. The media retaining belt 30 moves around the rollers 32, 33, 34, 35 together with the media applicator roll 12 as the media applicator roll 12 rotates.

In the preferred embodiment, the granule applicator roll 12 is rotatably coupled to the first roller 32 so that the media retaining belt 30 moves along with the media applicator roll 12. One way of rotatably coupling media applicator roll 12 to first roller 32 is by a belt or chain drive mechanism including a belt or chain 42 rotatably engaged with the media applicator roll 12. The belt or chain 42 is rotatably engaged with a first gear 43 which engages a second gear 44 coupled to the first roller 32. Rotational movement is transmitted to the first roller 32 as the media applicator roll 12 rotates, e.g. by a motor, as will be described below. The first gear 43 then rotates second gear 44 and the first roller 32, thereby moving the media retaining belt 30 along with the media applicator roll 12.

One example of the chain drive mechanism includes a chain 42, such as a 60 pitch single roller chain approximately 48 in. in length. The chain is engaged with a sprocket 45 coupled to the media applicator roll 12, such as a 60 pitch/48 tooth sprocket having an outer diameter of approximately 11.893 in. and a pitch diameter of approximately 11.468. The chain 42 engages a sprocket 46 coupled to the first gear 43, such as a 60 pitch/11 tooth sprocket having an outer diameter of approximately 3.005 in. and pitch diameter of approximately 2.663 in. In this example, the first and second gears 43, 44 are spur gears having 10 pitch/48 teeth, an outer diameter of approximately 5 in. and a pitch diameter of approximately 4.8. A chain drive mechanism according to this example, will transmit movement from the media applicator roll 12 to the first roller 32 and the media retaining belt 30 so that the media retaining belt 30 moves along with the media applicator roll 12 at approximately the same speed.

The second roller 33 has a relatively small preferred diameter in the range of approximately 1 to 2 inches and is located proximate the bottom region 15 such that the distance d that the media 2 drop from the media applicator roll 12 to the surface 22 is minimized. The distance d can be minimized by positioning the second roller 33 so that the lowest point 52 of the second roller 33 lies substantially in the same horizontal plane as the lowest point 54 of the media applicator roll 12.

A cam follower mechanism 36 having one or more cam follower wheels 37 can be used with the second roller 33 if the second roller 33 has a relatively small diameter and needs additional support along its length.

In one example, the second roller 33 has a diameter of approximately 2.375 in. and is supported by two cam follower wheels 37 along the length of the second roller 33. Using this second roller 33 of 2.375 in. allows a distance d of approximately 2 in. or less between the point that the media drop from the media receiving region 18 and the surface 22.

In one example, the first roller 32, the third roller 34, and the fourth roller 35 have an outer diameter of approximately 4 in. and are spaced from one another at approximately 18.5 in. center-to-center. In this example, the media retaining belt 30 is an endless belt of approximately 90 in. in length, and the media applicator roll 12 has a diameter of approximately 18.382 in. The present invention, however, contemplates different numbers of rollers and various dimensions for the rollers, belts, and applicator roll.

The preferred embodiment of the media applicator roll 12 includes a substantially cylindrical outer sleeve 8 having the media receiving region 18 and secured around an internal support 7. The internal support 7 is preferably made of a rigid material, such as metal, and the sleeve 8 is preferably made of rubber or a similar material but the present invention contemplates other suitable materials such as plastic and metal. The sleeve 8, in one embodiment, can be removably secured to the internal support 7 using bolts, screws or the like. A plurality of sleeves 8 having media receiving regions 18 of various predefined patterns can be interchanged to easily and quickly vary the predefined patterns deposited on the surface 22.

The media depositing apparatus 10 further includes support members 6, such as support plates, for rotatably supporting the media applicator roll 12, the rollers 32, 33, 34, 35, and the first and second gears 43, 44 and for supporting cam follower mechanism 36 having cam follower wheels 37.

Figure 3:
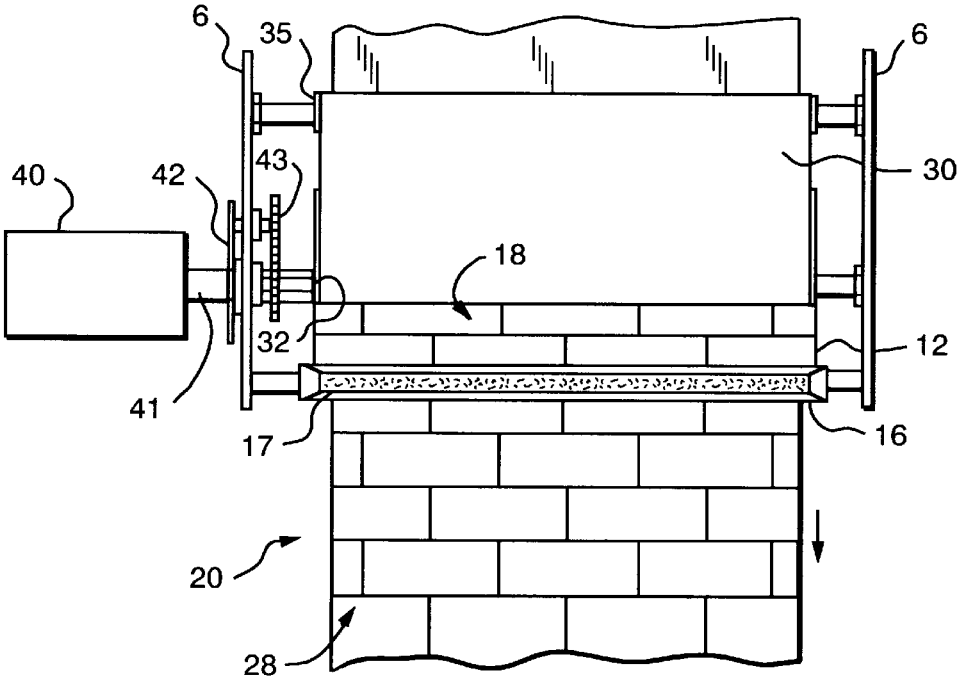
FIG. 3 is a top view of a system for depositing media in a predefined pattern including a moving surface having media deposited thereon in a predefined pattern according to one embodiment of the present invention.

A motor 40, FIG. 3, is coupled to a shaft 41 extending from the media applicator roll 12 for rotating the media applicator roll 12. Preferably the motor 40 is any type capable of driving a chain from a sprocket, e.g. a 3 to 5 h.p. motor. The applicator roll 12 may have its own drive system (motor, belt, gears, etc.) or may be driven from another source, as is well known in the art.

The media retaining belt 30 is approximately the same width of the media applicator roll 12. In one example, the media retaining belt 30 is approximately 42 in. wide and the media applicator roll 12 is approximately 43 in. wide. The width of the surface 22 also corresponds generally with the width of the applicator roll 12. In the example above, the width of the surface 22 is approximately 37 in. The present invention, however, contemplates media applicator rolls, media retaining belts, and surfaces of various sizes and dimensions.

One embodiment of the granule feeder 16 includes one or more hoppers extending at least part of the length of the media applicator roll 12. The hopper contains a supply of media 2, such as granules, that are fed to the entire length of the media receiving region 18, such as by gravity or by a mechanical feeding mechanism, as the media applicator roll 12 rotates. Preferably, the media feeder or hopper 16 includes a gasket or seal 17 around the opening of the media feeder or hopper 16 in contact with the media receiving region 18. The gasket or seal 17, typically made of a rubber or similar material, prevents media 2 from escaping as the media 2 are fed to the media receiving region 18. The media feeder or hopper 16 is supported between support members 6 and automatically replenished from a source of media(not shown).

Figure 4:
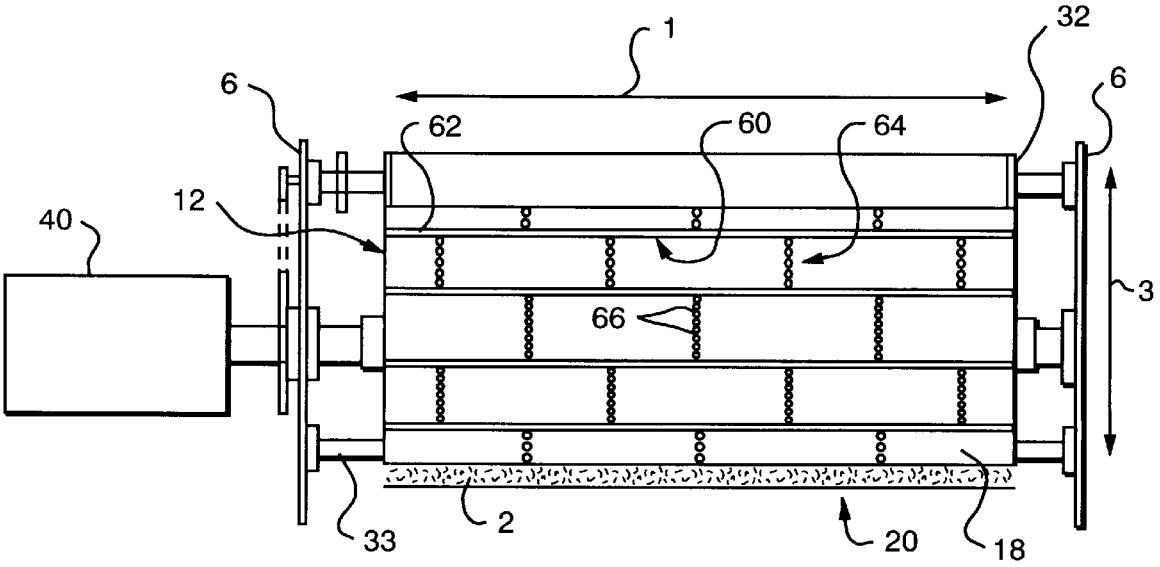
FIG. 4 is a side view of the media applicator roll including an media receiving region according to one embodiment of the present invention.

One embodiment of the media receiving region 18, FIG. 4, consists of a pattern of engraved portions 60, 64 that receive the media 2, such as granules, from the feeder 16 and hold the media as the media applicator roll 12 rotates. In one example, a first series of engraved portions 60 run substantially in an axial direction 1 along the media applicator roll 12 and are spaced circumferentially around the media applicator roll 12, e.g. at a predetermined distance of approximately 5.25 in. apart. A second series of engraved portions 64 run substantially in a circumferential direction 3 and are spaced axially on the media applicator roll 12, e.g. at a predetermined distance of approximately 11.75 in. apart.

The engraved portions 60, 64 arranged in this configuration deposit the media 2 in a simulated shingle pattern 28 (FIG. 3) on the moving sheet of material 20. The present invention contemplates various patterns of engraved portions 60, 64 to form various patterns other than a shingle pattern or to cover the entire surface 22.

The engraved portions 60 that run substantially in an axially direction 1 are preferably formed as slots 62. The engraved portions 64 running substantially in the circumferential direction 3 along the media applicator roll 12 are preferably formed as pockets 66.

Figure 5:
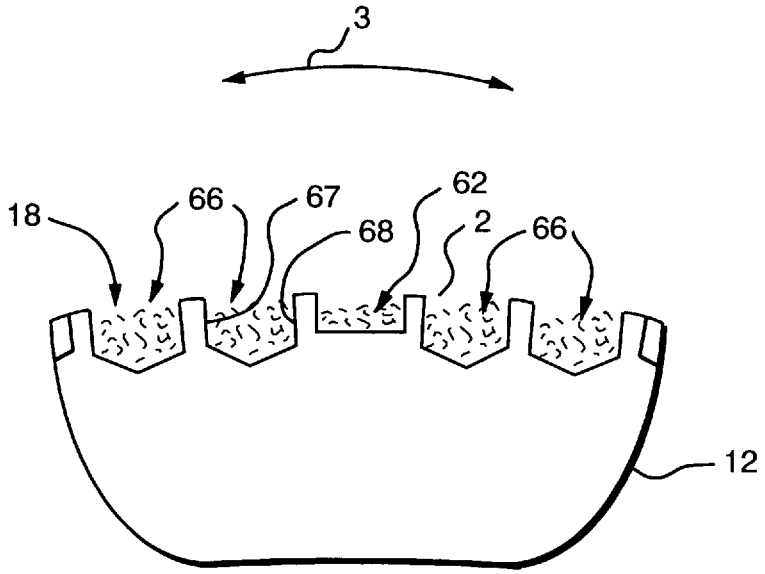
FIG. 5 is a cross-sectional view of an media receiving region having engraved portions on a media applicator roll according to one embodiment of the present invention.

A plurality of pockets 66, FIG. 5, are arranged substantially in the circumferential direction 3 along the media receiving region 18 of the media applicator roll 12 to form the engraved portions 64. Each pocket 66 includes side portions 67, 68 to prevent the media 2 contained within the pockets 66 from being displaced or sliding in the circumferential direction 3 as the media applicator roll 12 rotates. Thus, any engraved portion 64 that extends substantially in a circumference direction 3 is preferably formed as a series of pockets 66 so that the predefined pattern of the media is precisely maintained as the media applicator roll 12 rotates and deposits the media on the moving sheet of material. In addition to pockets, the present invention contemplates holes, grooves, or open areas that prevent the media from being displaced or sliding.

Figure 6:
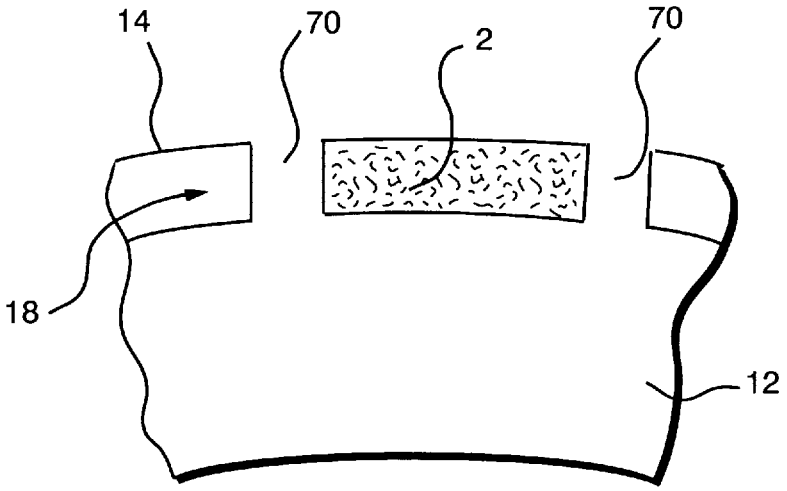
FIG. 6 is a cross-sectional view of an media receiving region having raised portions according to another embodiment of the present invention.

In another embodiment, the media receiving region 18, FIG. 6, of the media applicator roll 12 includes raised portions 70 that receive and hold media 2, such as granules, as the media applicator roll 12 rotates. The present invention also contemplates an media receiving region 18 having a combination of engraved and raised portions.

The method of depositing media in a predefined pattern on a moving surface includes rotating the media applicator roll at a predetermined speed and moving the surface at a predetermined speed beneath the media applicator roll and at a predetermined distance from the media applicator roll. In the preferred embodiment, the predetermined speed of rotation is synchronized to correspond with the predetermined speed of the moving surface 22. In other words, the linear velocity of the media applicator roll 12 at the point where the media are released from contact with the media receiving region 18 should substantially correspond with the linear velocity of the moving surface 22.

In one example, the surface 22 is moving at approximately 500 ft./min. and the speed of rotation of the media applicator roll 12 should be sufficient to provide a linear velocity of approximately 500 ft./min. at the point where the media are released. The present invention, however, contemplates moving the media applicator roll 12 and the moving surface 22 at different speeds.

Synchronizing the speed of rotation of the media applicator roll 12 and the speed of the moving surface 22 and minimizing the distance d that the media must drop from the media receiving region 18 to the moving surface allows the media to be dropped precisely in the predefined pattern. Such a controlled media drop prevents the media from shifting and prevents distortion of the predefined pattern of the media as the media are deposited on the surface 22.

Accordingly, the system and method for depositing the pattern of media according to the present invention allows media to be deposited in a predefined pattern and provides for a controlled media drop so that the media are precisely deposited in that predefined pattern. The present invention also provides a relatively simple system and method for depositing media in a predefined pattern that is productive and cost efficient.

Modifications and substitutions by one of ordinary skill in the art are considered to be within the scope of the present invention which is not to be limited except by the claims which follow.

What is claimed is:

1. A method of depositing granular media in a pattern directly on a moving surface of a continuous web, said method comprising the steps of:

rotating a media applicator roll;

moving said continuous web on which said granular media is to be deposited at a linear velocity beneath said media applicator roll;

feeding said granular media to a media receiving region on said media applicator roll;

maintaining said granular media in contact with said media receiving region of said media applicator roll from a top region of said media applicator roll to a bottom region beneath said media applicator roll; and releasing said granular media from said media receiving region of said media applicator roll at said bottom region directly onto said moving surface of said continuous web in said pattern, wherein said granular media is directly deposited on said moving surface at an acute angle with respect to said moving surface.

2. The method of claim 1, further including the step of synchronizing said speed of rotation of said media applicator roll and said speed of said moving surface.

3. The method of claim 1, wherein said granular material is media are deposited in a shingle pattern.

4. The method of claim 1, wherein said step of maintaining said granular media in contact with said media receiving region of said media applicator roll includes minimizing a distance between said bottom region of said media receiving region and said moving surface.

5. The method of claim 1 wherein a linear velocity of said media applicator roll at a point where said granular media are released substantially corresponds with said linear velocity of said moving surface of said continuous web.

6. A system for depositing granular media in a pattern on a moving web, said system comprising:

a means for moving said moving web at a linear velocity in a direction;

a media applicator roll, rotating in a direction and at a speed of rotation above said moving web, said media applicator roll having a media receiving region corresponding to said pattern, wherein said direction of said media applicator roll corresponds to said direction of said moving web, and wherein said speed of rotation of said media applicator roll is synchronized with respect to said means for moving said moving web; and a media retaining member, proximate at least a portion of said media applicator roll, for maintaining said granular media in said media receiving region of said media applicator roll as said media applicator roll rotates, wherein said media applicator roll and said media retaining member cooperate to release said granular media from said media receiving region of said media applicator roll at a linear velocity which substantially corresponds to said linear velocity of said moving web, and directly onto at least a top surface of said moving web in the form of said pattern.

7. The system of claim 6, wherein said media retaining member includes a media retaining belt.

8. The system of claim 6, wherein said portion of said media applicator roll proximate said media retaining member begins proximate a top region of said media applicator roll and extends circumferentially around said media applicator roll to proximate a bottom region of said media applicator roll, wherein said media retaining member cooperates with said media applicator roll at said bottom region such that said granular media are deposited from said media receiving region at said bottom region of said media applicator roll to said moving surface at an acute angle with respect to said moving surface.

9. The system of claim 6, further including a sheet of material moving beneath said media applicator roll; and wherein said sheet of material includes said moving surface on which said media is deposited.

10. The system of claim 9, wherein said sheet of material includes a web material covered at least on one surface with an asphaltic material.

11. The system of claim 10, wherein said web material includes at least one of fiberglass, polyester, paper, polyethylene, felt, polypropylene and metal.

12. The system of claim 6, wherein said moving surface is positioned proximate said media applicator roll to minimize a distance between a bottom region of said media applicator roll and said moving surface.

13. The system of claim 6, wherein said media receiving region of said media applicator roll is made of a rubber material.

14. The system of claim 6, wherein said media applicator roll includes an internal support and a substantially cylindrical sleeve, said substantially cylindrical sleeve positioned over said internal support and including said media receiving region.

15. The system of claim 6, wherein said media retaining member includes a chute positioned proximate said portion of said media applicator roll.

16. The system of claim 6, further including a media feeder proximate said media applicator roll, for feeding media to said media receiving region of said media applicator roll.

17. A media depositing apparatus, for depositing media in a pattern on a moving surface, said media depositing apparatus comprising:

a media applicator roll having a media receiving region corresponding to the pattern to be deposited on the moving surface; and a media retaining belt proximate at least a portion of said media receiving region of said media applicator roll and movable with said applicator roll, for maintaining media in contact with said media receiving region of said media applicator roll until the media in said media receiving region reach a bottom region of said media applicator roll, said media retaining belt terminating at said bottom region of said media applicator roll and beneath said media applicator roll, wherein said media applicator roll and said media retaining belt cooperate to release said media from said bottom region of said media applicator roll and said media retaining belt and directly onto said moving surface.

18. The media depositing apparatus of claim 17, wherein said media retaining belt extends substantially across a width of said media applicator roll from a top region of said media applicator roll to said bottom region of said media applicator roll.

19. The media depositing apparatus of claim 8, further including at least a first roller holding said media retaining belt in contact with said media receiving region at said top region of said media applicator roll and at least a second roller holding said media retaining belt in contact with said media receiving region at said bottom region of said media applicator roll, wherein said media retaining belt runs continuously around said at least first and second rollers as said media applicator roll rotates.

20. The media depositing apparatus of claim 17, wherein said media applicator roll includes an internal support and a substantially cylindrical sleeve having said media receiving region, wherein said substantially cylindrical sleeve is removably positioned over said internal support.

21. The media depositing apparatus of claim 17, wherein said media receiving region of said media applicator roll includes at least one of an engraved portion and a raised portion.

22. A system for depositing granular media in a pattern on a moving web, said system comprising:

a media applicator roll, rotating at a speed of rotation above said moving web, said media applicator roll having a media receiving region corresponding to said pattern to be deposited on said moving web, wherein said speed of rotation of said media applicator roll is synchronized with respect to a speed of said moving web; and a media retaining member, proximate at least a portion of said media applicator roll, for maintaining said granular media in said media receiving region of said media applicator roll as said media applicator roll rotates, said media retaining member terminating at a bottom region of said media applicator roll and beneath said media applicator roll, wherein said media applicator roll and said media retaining member cooperate to release said granular media directly onto at least a top surface of said moving web in said pattern.

23. The system of claim 22 further including a media feeder disposed proximate an upper side region of said media applicator roll at an acute angle from a top most point of said media applicator roll, for feeding media to said media receiving region of said media applicator roll.

24. The system of claim 22 wherein said media receiving region includes a plurality of pockets formed in a surface of said media applicator roll and arranged in said pattern, for receiving said granular media from a media feeder as said media applicator roll rotates.

* * * * *